US008939700B2

(12) United States Patent
Cate et al.

(10) Patent No.: US 8,939,700 B2
(45) Date of Patent: Jan. 27, 2015

(54) BUCKET CYLINDER DEBRIS GUARD

(75) Inventors: Robert R. Cate, Dubuque, IA (US); Dennis A. Brimeyer, Dubuque, IA (US); Jessica A. Hill, Platteville, WI (US)

(73) Assignee: Deere & Company, Moline, IL (US)

( * ) Notice: Subject to any disclaimer, the term of this patent is extended or adjusted under 35 U.S.C. 154(b) by 811 days.

(21) Appl. No.: 13/126,592

(22) PCT Filed: Jan. 28, 2009

(86) PCT No.: PCT/US2009/000550

§ 371 (c)(1),
(2), (4) Date: Jul. 12, 2011

(87) PCT Pub. No.: WO2010/087792

PCT Pub. Date: Aug. 5, 2010

(65) Prior Publication Data

US 2011/0274528 A1 Nov. 10, 2011

(51) Int. Cl.

| | |
|---|---|
| ***E02F 3/00*** | (2006.01) |
| ***E02F 3/34*** | (2006.01) |
| ***E02F 9/22*** | (2006.01) |

(52) U.S. Cl.

CPC ..... *E02F 3/34* (2013.01); *E02F 9/2271* (2013.01); *E02F 3/3405* (2013.01)

USPC ..... 414/722; 74/566; 172/81; 172/508

(58) Field of Classification Search

CPC ..... E02F 9/2271

USPC ..... 414/685, 722; 74/566; 172/81, 508

See application file for complete search history.

(56) References Cited

U.S. PATENT DOCUMENTS

| | | | | |
|---|---|---|---|---|
| 2,764,303 | A | | 7/1954 | Austin, Sr. |
| 3,305,118 | A | * | 2/1967 | Lull ..... 414/732 |
| 3,542,223 | A | | 11/1970 | Carter |
| 3,578,377 | A | | 5/1971 | Babbitt |
| 3,982,648 | A | | 9/1976 | Luedtke |
| 3,997,986 | A | | 12/1976 | Black et al. |
| 4,017,114 | A | * | 4/1977 | LaBounty ..... 414/732 |
| 4,055,262 | A | | 10/1977 | Bauer |
| 4,074,782 | A | | 2/1978 | Bauer |
| 4,131,225 | A | | 12/1978 | Bauer |

(Continued)

OTHER PUBLICATIONS

Notification Concerning Transmittal of International Preliminary Report on Patentability and the International Preliminary Report on Patentability (6 pages) (Aug. 11, 2011).

(Continued)

*Primary Examiner* — Gerald McClain

(57) ABSTRACT

A loader for a work vehicle comprises a lift arm, a bucket, a bucket linkage, and a hydraulic bucket cylinder. The bucket and the linkage are pivotally attached to the lift arm. The linkage comprises a first link and a second link, which are pivotally attached to the bucket. The bucket cylinder is pivotally attached to the first and second links and the bucket and operable to pivot the bucket relative to the lift arm. The linkage comprises a debris guard substantially obstructing a space defined between the first and second links and between the bucket cylinder and the bucket.

16 Claims, 7 Drawing Sheets

(56) References Cited

U.S. PATENT DOCUMENTS

| | | | | | |
|---|---|---|---|---|---|
| 4,150,474 | A | | 4/1979 | Bauer | |
| 4,189,010 | A | | 2/1980 | Meisel, Jr. | |
| 4,411,081 | A | | 10/1983 | King | |
| 4,413,708 | A | | 11/1983 | Stedman | |
| 4,936,193 | A | | 6/1990 | Stoll | |
| 5,152,351 | A | | 10/1992 | Rieger | |
| 5,292,079 | A | * | 3/1994 | Zakohji | 414/740 |
| 5,386,652 | A | | 2/1995 | Ramun | |
| 5,687,800 | A | * | 11/1997 | Wilkening | 172/811 |
| 5,865,492 | A | * | 2/1999 | Horton | 414/732 |
| 2008/0061484 | A1 | | 3/2008 | Seino et al. | |

OTHER PUBLICATIONS

Notification of Transmittal of the International Search Report and the Written Opinion of the International Searching Authority, or the Declaration; the International Search Report, and the Written Opinion of the International Searching Authority (7 pages) (Apr. 14, 2009).

Deere 410G Backhoe Loader, Loader Images (3 pages) (Jan. 7, 2009).

Deere J Dozers Brochure (24 Pages)(2007).

Excavator Boom Cylinder Guard Image (1 page)(prior art before Jan. 28, 2009).

Background Information (1 page)(prior art before Jan. 28, 2009).

* cited by examiner

Fig. 1A
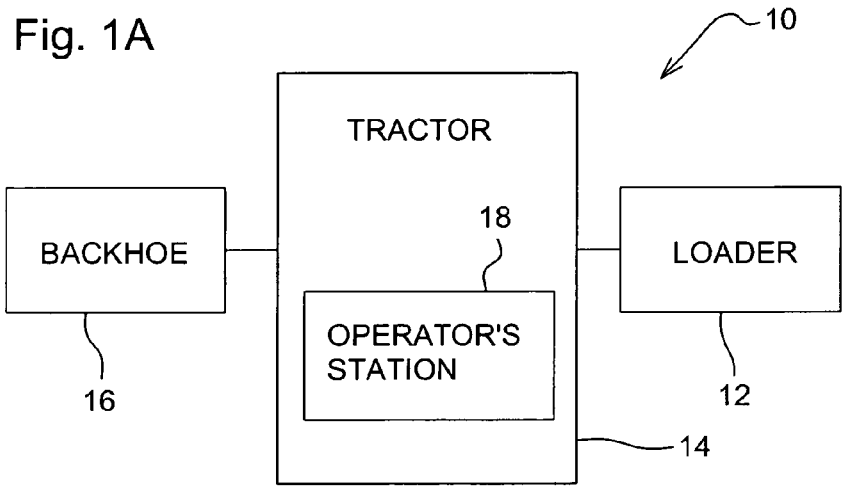
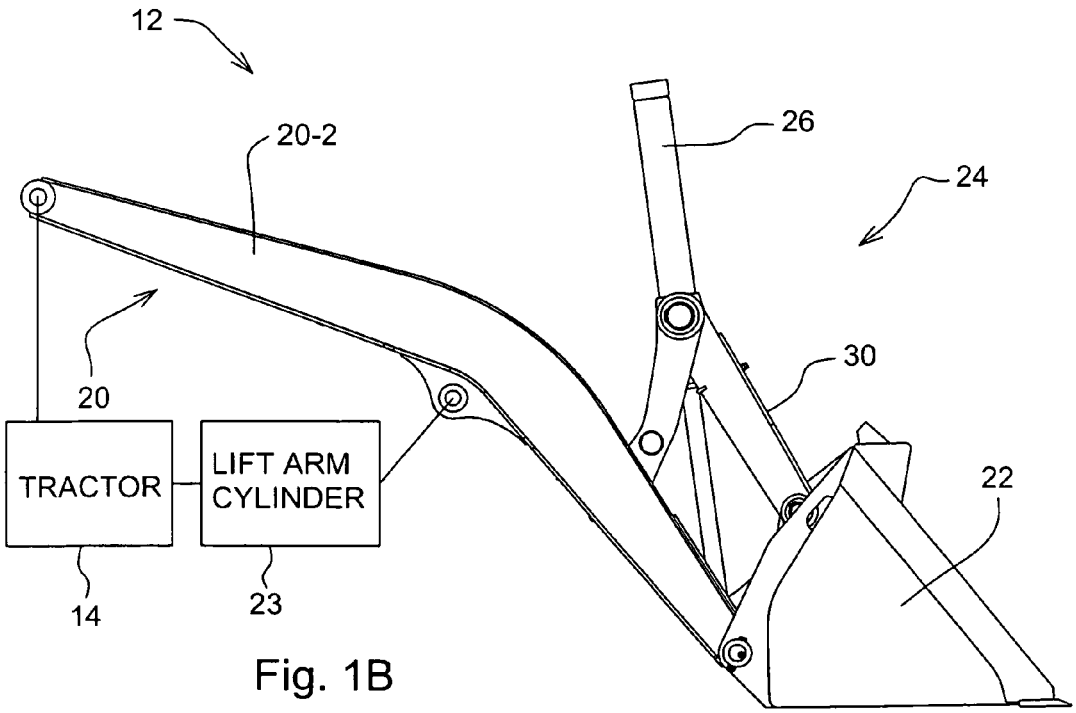
Fig. 1B 36
54
24-3
134
132
130-1
58
56
θ
11
12
13
14

BUCKET CYLINDER DEBRIS GUARD

FIELD OF THE DISCLOSURE

The present disclosure relates to a loader for a work vehicle and, more particularly, to a debris guard for a hydraulic bucket cylinder of the loader.

BACKGROUND OF THE DISCLOSURE

There are work vehicles, such as, for example, backhoe loaders, which have a loader with a lift arm, a bucket pivotally attached to the lift arm, a bucket linkage pivotally attached to the lift arm and the bucket, and a hydraulic bucket cylinder pivotally attached to the linkage and the bucket and operable to pivot the bucket relative to the lift arm. The lift arm can be used to raise and lower the bucket, and the hydraulic bucket cylinder can be used to roll the bucket back to hold material in the bucket and to roll the bucket forward to dump material.

SUMMARY OF THE DISCLOSURE

According to an aspect of the present disclosure, there is provided a loader for a work vehicle. The loader comprises a lift arm, a bucket, a bucket linkage, and a hydraulic bucket cylinder. The bucket and the linkage are pivotally attached to the lift arm. The linkage comprises a first link and a second link, which are pivotally attached to the bucket. The bucket cylinder is pivotally attached to the first and second links and the bucket and operable to pivot the bucket relative to the lift arm. The linkage comprises a debris guard extending along and between the first and second links and over a portion of the bucket cylinder extending between the bucket linkage and the bucket (e.g., the rod), substantially obstructing a space defined between the first and second links and between the bucket cylinder and the bucket.

As such, the debris guard is arranged to block passage of potentially cylinder-damaging material (e.g., large rocks) between the first and second links into a pinch region located between the cylinder portion and a portion of the bucket located between the cylinder portion and the first and second links. Exemplarily, the debris guard is arranged to block passage of such material between the links onto the rod of the cylinder between a pair of pivot plates to which the links and rod are pivotally attached to prevent such material from lodging in that pinch region. The debris guard thereby protects the cylinder portion (e.g., the rod) from damage in the form of, for example, a bent, broken, and/or scored rod upon roll-back of the bucket. Such scoring could damage the seals of the cylinder, leading to external leakage of the cylinder.

The debris guard may thus be useful during various operations of the loader. For example, in a grading operation, the bucket may be rolled forward (e.g., to its full roll-forward or dump position, or some position short of that extreme position) in order to use the top edge of the bucket to grade material. During such grading, material may flow over the top edge of the bucket, in which case the debris guard is arranged to block material that might otherwise threaten the cylinder (e.g., the rod) upon roll-back of the bucket. The debris guard may also be useful in a digging operation in which the bucket is over-filled. During such an operation, material may spill over the top edge of the bucket, in which case the debris guard is arranged to block material that might otherwise threaten the cylinder (e.g., the rod) upon roll-back of the bucket.

In an embodiment, the debris guard is fastened to the first and second links for removal therefrom. As such, should the debris guard be bent or otherwise damaged by material pinched between the debris guard and the bucket upon roll-back of the bucket, the debris guard can be removed and replaced.

In another embodiment, the debris guard is integral with the first and second links. In such a case, the debris guard may comprise a first component integral with the first link and a second component distinct from the first component and integral with the second link. The first and second components may be cast respectively with the first and second links, minimizing costs associated with inclusion of the debris guard.

The above and other features will become apparent from the following description and the attached drawings.

BRIEF DESCRIPTION OF THE DRAWINGS

The detailed description of the drawing refers to the accompanying figures in which:

FIG. 1A is diagrammatic view of a work vehicle in the form of, for example, a backhoe loader;

FIG. 1B is a side elevation view of a loader for the work vehicle;

DETAILED DESCRIPTION OF THE DRAWINGS

Figure 2:
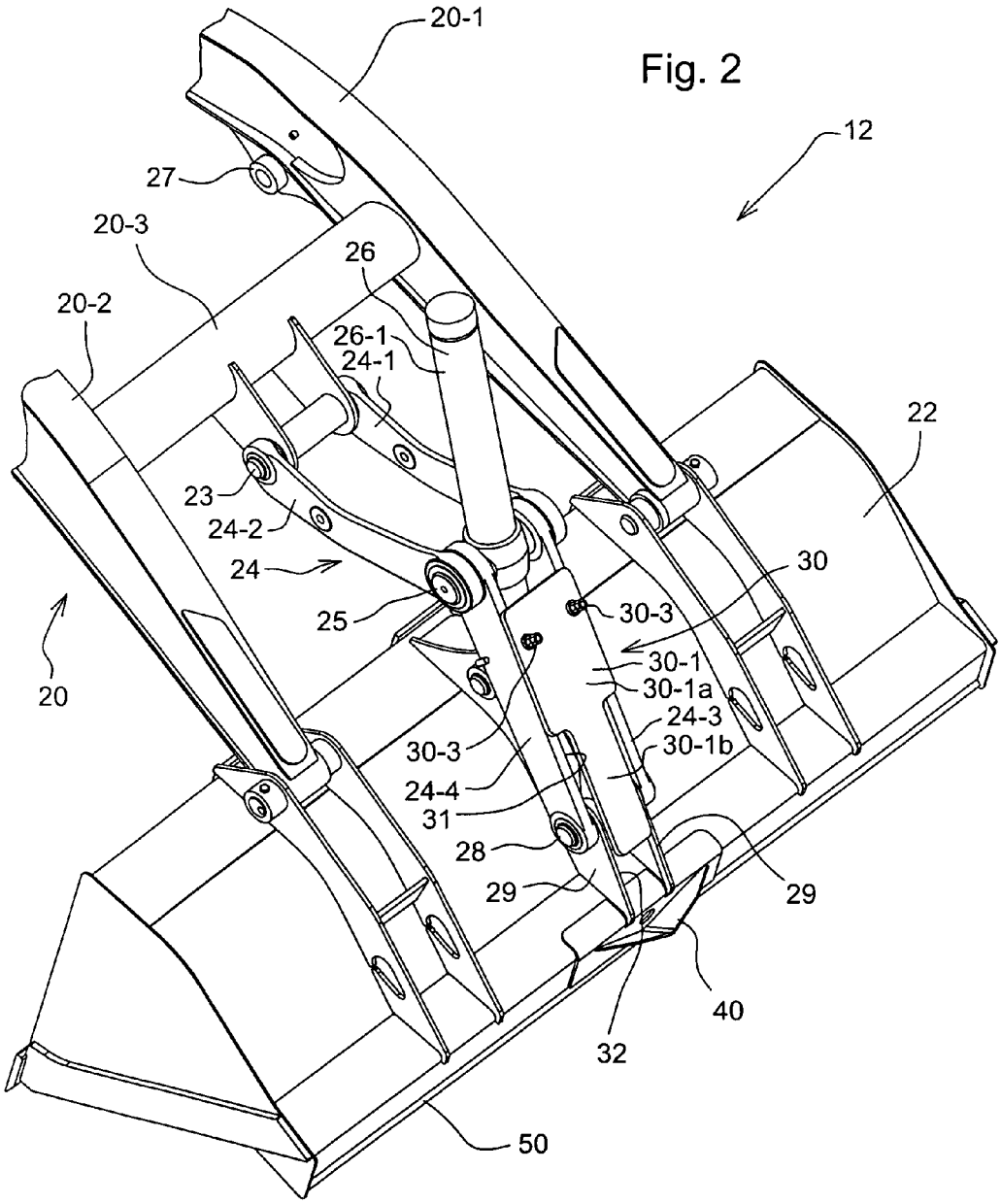
FIG. 2 is a fragmentary perspective view of the loader with a first embodiment of a debris guard included in the bucket linkage.

Referring to FIG. 1A, there is shown a work vehicle 10. The work vehicle 10 is, for example, a John Deere 410J backhoe loader ("410J") and is exemplarily described as such in this detailed description. The vehicle 10 has a loader 12 attached to the front of the tractor 14, and a backhoe 16 attached to the rear of the tractor 14. The loader 12 is configured for digging into a pile of material in one location and dumping the material in another location. The backhoe 16 is configured for an excavating operation. Both portions of the vehicle 10 can be controlled by a human operator from the operator's station 18 using various controls in the operator's station 18.

Figure 3:
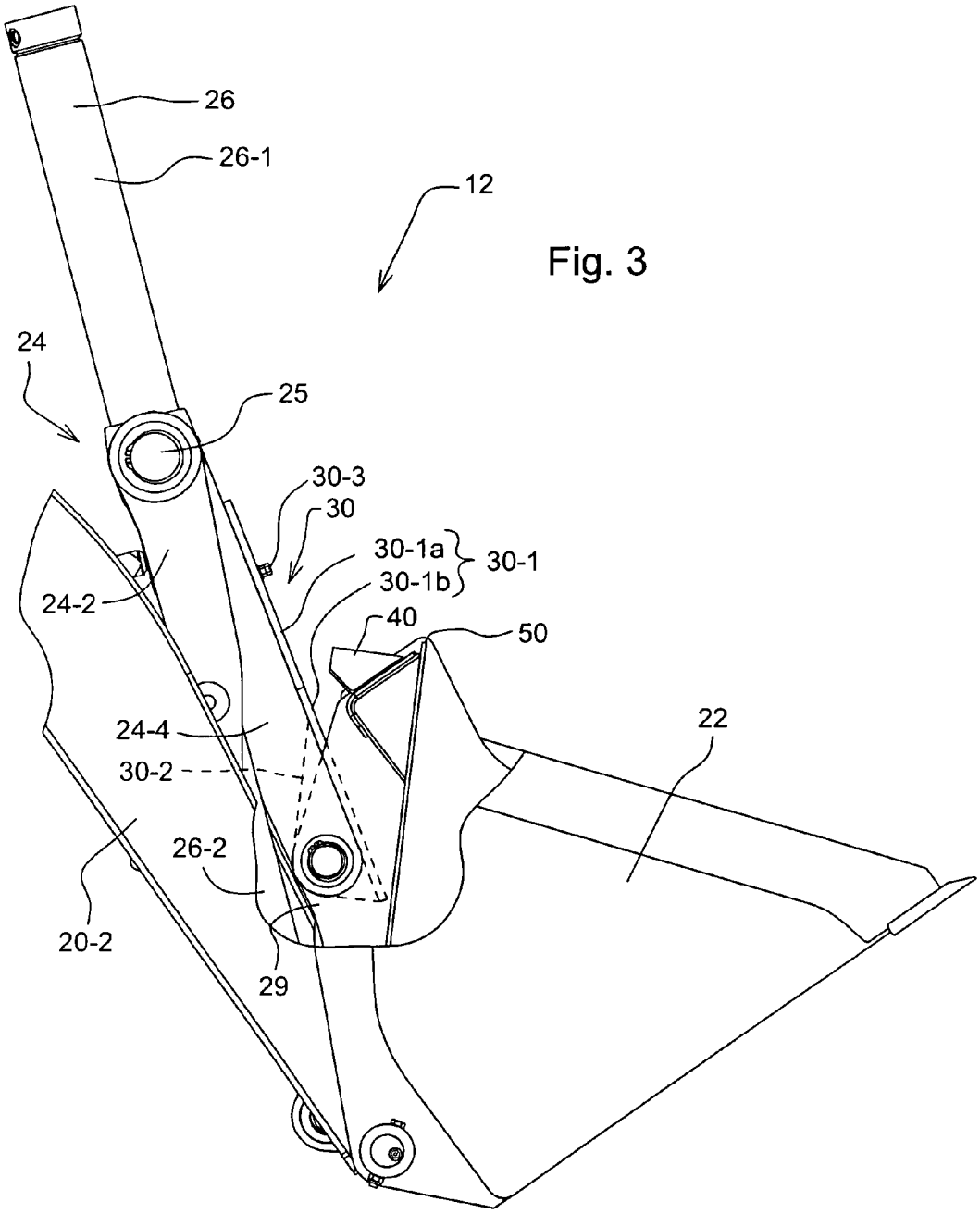
FIG. 3 is a fragmentary side elevation view of the loader showing the first debris guard and the bucket in its full roll-back position.
Figure 4:
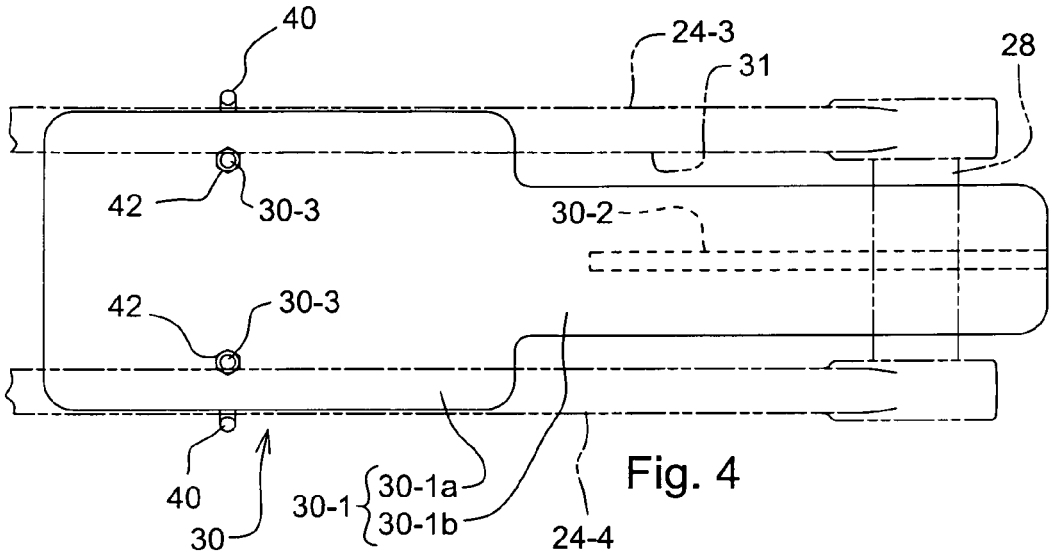
FIG. 4 is a top view of the first debris guard.
Figure 5:
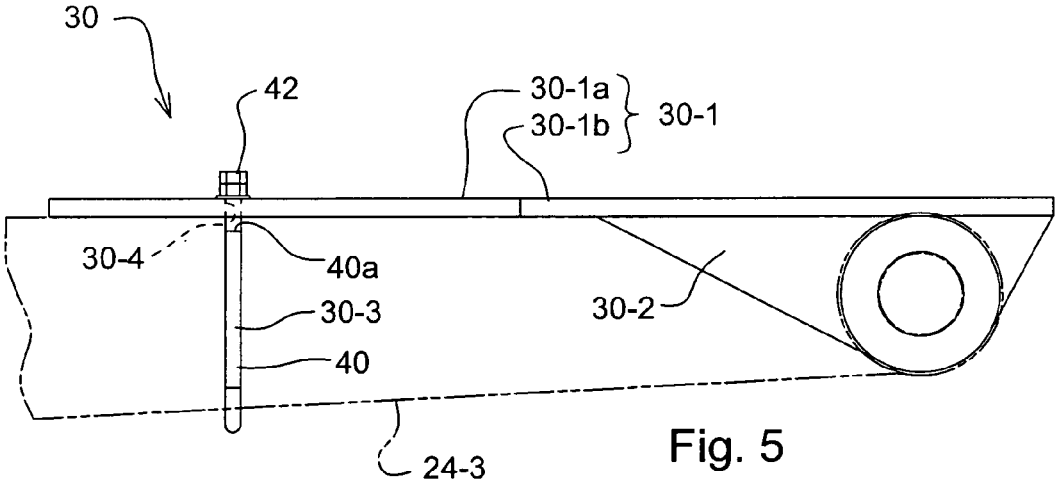
FIG. 5 is a side elevation view of the first debris guard.
Figure 6:
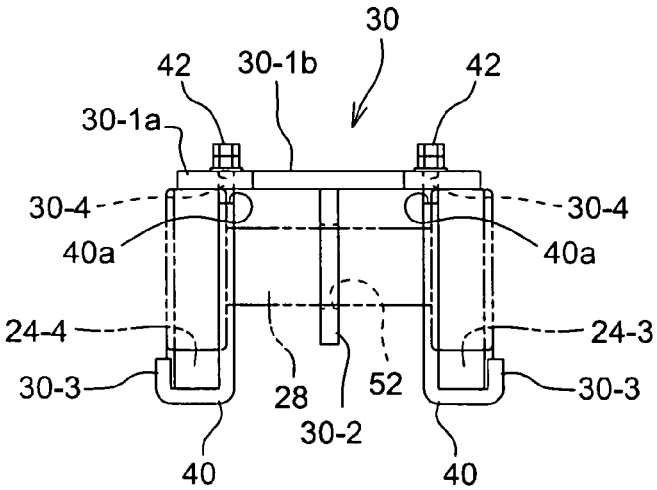
FIG. 6 is an end elevation view of the first debris guard.
Figure 7:
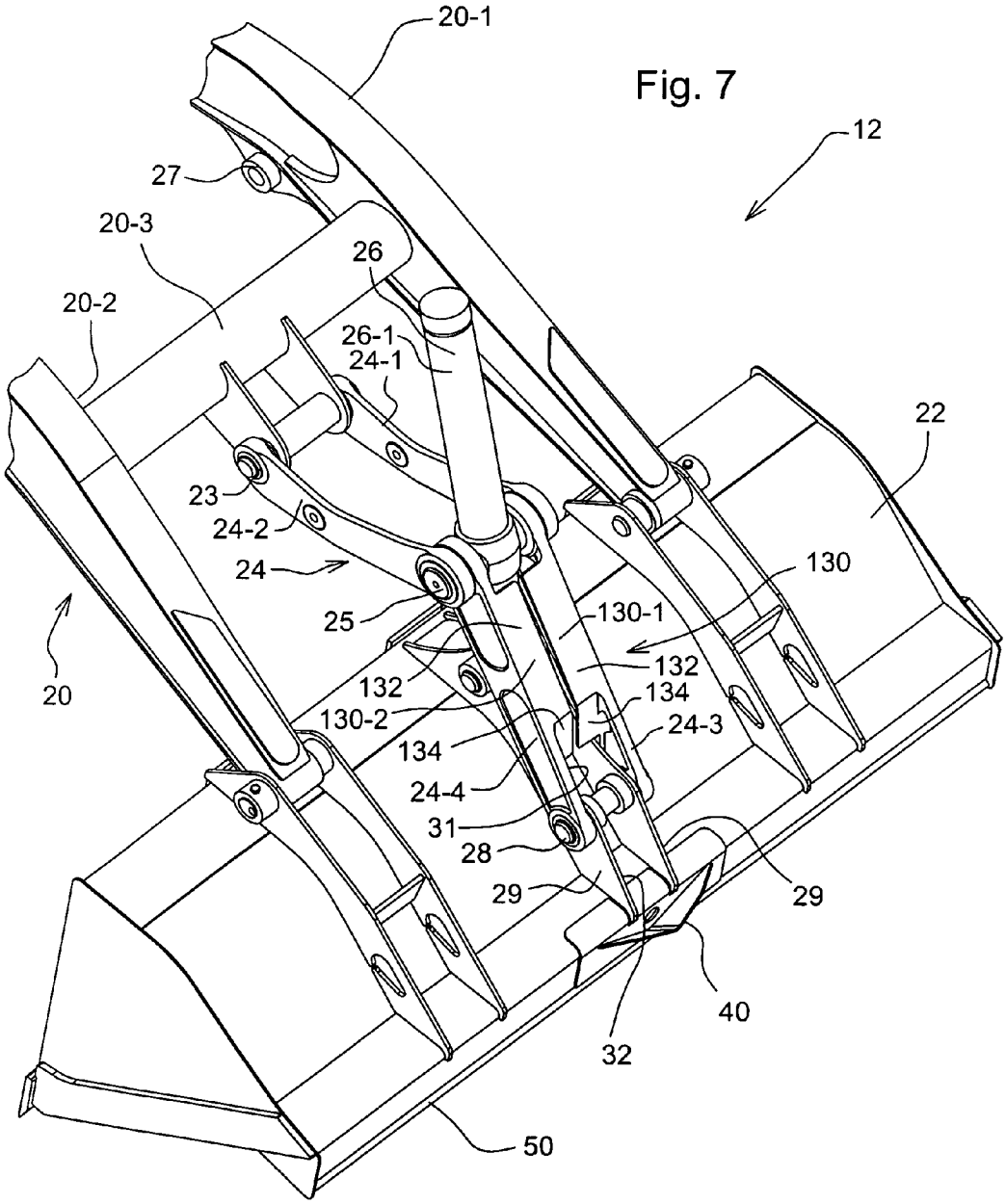
FIG. 7 is a fragmentary perspective view of the loader with a second embodiment of the debris guard included in the bucket linkage.

Referring to FIGS. 1B, 2, and 3, the loader 12 includes a lift arm 20, a bucket 22, a bucket linkage 24, and a hydraulic bucket cylinder 26. The lift arm 20 has left and right fore-aft beams 20-1, 20-2 and a cross beam 20-3 extending between and welded to the fore-aft beams 20-1, 20-2. The inboard end of each beam 20-1, 20-2 is pivotally attached to the tractor 14, such as in a conventional manner (e.g., as on the 410J) in which a lubricated pin is received within the respective inboard end and the corresponding component of the tractor 14. The bucket 22 is pivotally attached to the outboard ends of the beams 20-1, 20-2, such as in a conventional manner (e.g., as on the 410J) in which a lubricated pin is received within the respective outboard end and a pair of pivot plates of the bucket 22.

Left and right hydraulic lift arm cylinders 23, one of which is shown diagrammatically in FIG. 1B, are positioned on either side of the tractor 14 and pivoted to the tractor 14 and respectively to the left and right beams 20-1, 20-2 (at pivot points 27, as shown, for example, with respect to beam 20-1) using pivot pins so as to extend respectively between the tractor 14 and the left and right beams 20-1, 20-2 in order to raise and lower the lift arm 20 and thus the bucket 22. The left and right hydraulic lift arm cylinders may be so arranged in a conventional manner (e.g., as on the 410J).

The linkage 24 is pivotally attached to the lift arm 20 and the bucket 22. The linkage 24 has left and right inboard links 24-1, 24-2 and left and right outboard links 24-3, 24-4. The inboard links 24-1, 24-2 are pivotally attached to the cross-beam 20-3, such as in a conventional manner (e.g., as on the 410J) in which a pin 23 is received within the inboard links 24-1, 24-2, a pair of pivot plates welded to the cross-beam 20-3, an internally lubricated tube extending between and welded to the pivot plates, and a pair of bushings received in a channel defined by such pivot plates and tube. The outboard links 24-3, 24-4 are pivotally attached to the bucket 22, such as in a conventional manner (e.g., as on the 410J) in which a lubricated pin 28 is received within the outboard links 24-3, 24-4 and a pair of pivot plates 29 of the bucket 22.

The barrel 26-1 of the bucket cylinder 26 is pivotally attached to the linkage 24 at a barrel mounting point, such as in a conventional manner (e.g., as on the 410J). The barrel 26-1 is pivotally attached to the inboard links 24-1, 24-2 and the outboard links 24-3, 24-4 using a first pin extending from a collar, surrounding the barrel 26-1, and positioned within the links 24-1, 24-3 and a second pin extending from the collar and positioned within the links 24-2, 24-4, the second pin identified as 25, the first pin being like the second pin. The inboard links 24-1, 24-2 and the outboard links 24-3, 24-4 are thus pivotable relative to one another such that the linkage 24 is changeable in shape.

The rod 26-2 of the cylinder 26 is pivotally attached to the bucket 22, such as in a conventional manner (e.g., as on the 410J) in which a lubricated pin is received within a ring at the end of the rod 26-2 and the pair of pivot plates 29.

The cylinder 26 is operable to pivot the bucket 22 relative to the lift arm 20. Full retraction of the rod 26-2 into the barrel 26-1 of the cylinder 26 causes the bucket 22 to assume its full roll-back position, and full extension of the rod 26-2 from the barrel 26-1 causes the bucket 22 to assume its full roll-forward or dump position. Change in length of the cylinder 26 thus changes the position of the bucket 22 relative to the lift arm 20.

The linkage 24 comprises a debris guard extending longitudinally along and laterally between the outboard links 24-3, 24-4 and over a portion of the cylinder 26 extending between the linkage 24 and the bucket 22 (e.g., the rod 26-2). The debris guard substantially obstructs a space 31 defined between the links 24-3, 24-4 and between the cylinder 26 and the bucket 22.

The debris guard is arranged to block potentially cylinder-damaging material (e.g., large rocks) that may pass over the top edge 50 of the bucket 22, such as during, for example, a grading operation (using the top edge 50) or a digging operation. More particularly, the debris guard is arranged to block passage of such potentially cylinder-damaging material between the links 24-3, 24-4 into a pinch region located between the rod 26-2 and a portion of the bucket 22 (e.g., a portion of the pivot plates 29) located between the rod 26-2 and the links 24-3, 24-4. Stated otherwise, the debris guard is arranged to block passage of such material between the links 24-3, 24-4 onto the rod 26-2 between the pivot plates 29 to prevent such material from lodging in that pinch region. The debris guard thereby protects the rod 26-2 from damage in the form of, for example, a bent, broken, and/or scored rod 26-2 that could otherwise occur upon roll-back of the bucket 22. Such scoring could damage the seals of the cylinder 26, leading to external leakage of the cylinder 26.

The debris guard is distinct from a debris deflector 40 which may be of conventional design (e.g., as on the 410J) and position on the bucket 22. The debris deflector 40 has walls that are welded to the bucket 22 and diverge from one another to deflect material away from the cylinder 26. The debris guard is designed to block material that could pose a risk of damage to the cylinder rod portion despite the presence of the deflector 40.

Referring to FIGS. 2-6, in a first embodiment, the debris guard may be configured as a debris guard 30. The debris guard 30 is fastened to the outboard links 24-3, 24-4 for removal therefrom and is pivotally attached to the bucket 22 for removal therefrom. The debris guard 30 has a plate 30-1 extending longitudinally between the bucket 22 and the cylinder 26 and laterally between the links 24-3, 24-4, a flange 30-2 fixed (e.g., welded) to the bottom of the plate 30-1, and two hooks 30-3.

Each of the plate 30-1 and flange 30-2 has a thickness of, for example, 12 millimeters. In addition, each of the plate 30-1 and flange 30-2 is made of, for example, the material specified according to ASTM A1018 Grade HSLAS-F 50 or ASTM A1018M Grade HSLAS-F 340. In the case of either material specification, each of the plate 30-1 and the flange 30-2 is made from, for example, hot-rolled high-strength low-alloy steel sheet or strip in heavy thickness coils, with yield strength ≥340 MPa and good formability. More particularly, either material specification can be applied to hot-rolled sheets in coils of thickness ≥6 millimeters to ≤25 millimeters and width >300 millimeters to ≤1200 millimeters or hot-rolled strips in coils of thickness ≥6 millimeters to ≤25 millimeters and width >200 millimeters to ≤300 millimeters.

The plate 30-1 has a panel 30-1*a* and a tang 30-1*b* extending from the panel 30-1 toward the bucket 22 into a gap 32 between the pivot plates 29. A first of the hooks 30-3 attaches the panel 30-1*a* to the link 24-3, and a second of the hooks 30-3 attaches the panel 30-1*a* to the link 24-4. The hooks 30-3 thus attach the panel 30-1*a* onto a top surface of the links 24-3, 24-4.

Each hook 30-3 includes, for example, a bent threaded bolt 40 and a bolt retainer 42. The bolt 40 has a threaded portion 40*a* (i.e., the portion of the bolt 40 above the line to which the lead line of 40*a* touches) and a bent portion 40*b*. The threaded portion 40*a* is, for example, an M10 thread, and the bent portion 40*b* has an outer diameter of, for example, 10 millimeters. The threaded portion 40*a* extends through a respective hole 30-4 formed in the panel 30-1*a*. The hole 30-4 has an inner diameter of, for example, 13 millimeters. The bent portion 40*b* is hooked onto the underside of the respective link 24-3, 24-4. The retainer 42 includes a pair of nuts and a flat washer. The nuts are threaded onto the threaded portion 40*a* of the bolt 40, one on top of the other (the upper nut to inhibit the lower nut from backing off), so as to sandwich the washer between the lower of the two nuts and the panel 30-1*a*.

The two holes 30-4 in the panel 30-1*a* may be formed by any suitable method. For example, to form the two holes 30-4, the panel 30-1*a* may be drilled therethrough or may be laser-cut therethrough. In the case of laser-cutting, the laser may cut from the respective side of the panel 30-1*a* laterally inwardly to the location selected for the respective hole 30-4, leaving a laser kerf perpendicular from each side to the respective hole 30-4.

The panel 30-1*a* is positioned on the periphery of the links 24-3, 24-4 so as to span between the links 24-3, 24-4. The width of the panel 30-1*a* is equal to or less than the outer width of the links 24-3, 24-4 to prevent the panel 30-1*a* from overhanging the links 24-3, 24-4 and thus from catching on an object. The width of the panel 30-1*a* is, for example, less than the outer width of the links 24-3, 24-4, accommodating manufacturing tolerances and potential slight sideshifting of the links 24-3, 24-4. The width of the panel 30-1*a* is, for example, 200 millimeters and the outer width of the links 24-3, 24-4 is, for example, 207.9 millimeters.

The tang 30-1*b* is elongated and relatively narrow. It is narrower than a gap 32 between the pivot plates 29 so that it can extend into that gap 32 for attachment of the flange 30-2 to the pin 28. As such, the tang 30-1*b* is narrower than the panel 30-1*a* and narrower than the gap 31 between the links 24-3, 24-4.

The flange 30-2 is welded to the underside of the tang 30-1*b* so as to depend therefrom. The flange 30-2 has a hole 52 through which the pin 28 extends. As such, the flange 30-2 and pin 28 are relatively pivotable.

The plate 30-1 obstructs much of the space between the links 24-3, 24-4. As such, it prevents potentially cylinder-damaging material (e.g., larger rocks) from falling between the links 24-3, 24-4 onto the rod 26-2, which may otherwise damage the rod 26-2 upon roll-back of the bucket 22. Smaller material that may fall between the links 24-3, 24-4 onto the rod 26-2 in the pinch region between the rod 26-2 and the bucket 22 would not be large enough to damage the rod 26-2 upon roll-back of the bucket 22.

During installation of the debris guard 30, the flange 30-2 is pinned to the pivot plates 29 using the pin 28. The panel 30-1*a* is then hooked onto the links 24-3, 24-4. In so doing, the threaded portions 40*a* of the bolts 40 are inserted through the holes 30-4 in the panel 30-1*a* from the back of the panel 30-1*a*, and the bent portions 40*b* of the bolts 40 are hooked onto the links 24-3, 24-4. The retainers 42 are then threaded onto the threaded portions 40*a*.

Should the plate 30-1 become damaged by material lodging between the plate 30-1 and the bucket 22, the debris guard 30 may be replaced with a fresh debris guard 30 by following the installation steps in reverse, after which a fresh debris guard 30 may be installed.

Referring to FIGS. 7-14, in a second embodiment, the debris guard is configured as a debris guard 130 integral with the links 24-3, 24-4. The debris guard 130 has a first component 130-1 and a second component 130-2 distinct from the first component 130-1. The link 24-3 and the first component 130-1 are included in the same casting, such that the first component 130-1 is integral with the link 24-3 to form a monolithic structure. The link 24-4 and the second component 130-2 are included in the same casting, such that the second component 130-2 is integral with the link 24-4 to form a monolithic structure. Each such casting is made of, for example, ductile iron with tensile strength ≥550 MPa, yield strength ≥350 MPa, elongation yield ≥6%, hardness Brinell ≥173 and ≤255, the particular material being as specified according to ASTM A536 Grade 80-55-06. ASTM A536 is hereby incorporated by reference herein.

Each casting (i.e., link plus component) may be constructed so as to have the same weight as the links 24-3, 24-4 described in connection with the debris guard 30. Alternatively, the links 24-3, 24-4 described in connection with the debris guard 130 may have the same weight as the links 24-3, 24-4 described in connection with the debris guard 30, such that the components 130-1, 130-2 add weight to the castings.

The components 130-1, 130-2 extend longitudinally along the links 24-3, 24-4 between the bucket 22 and the cylinder 26 and laterally toward one another. The components 130-1, 130-2 cooperate to obstruct much of the space between the links 24-3, 24-4. As such, they are designed to prevent potentially cylinder-damaging material (e.g., larger rocks) from falling between the links 24-3, 24-4 onto the rod 26-2 in the pinch region between the rod 26-2 and the bucket 22, which may otherwise damage the rod 26-2 upon roll-back of the bucket 22. Smaller material that may fall between the links 24-3, 24-4 onto the rod would not be large enough to damage the rod 26-2 upon roll-back of the bucket 22. The components 130-1, 130-2 are spaced apart from one another to provide a small clearance between one another, accommodating slight sideshifting of the links 24-3, 24-4.

Each of the components 130-1, 130-2 has an elongated first wall 132 and a second wall 134. The thickness of the walls 132, 134 is, for example, 14 millimeters. The first wall 132 extends longitudinally along a top edge 36 of the respective link 24-3, 24-4 and laterally inwardly from the top edge 36 and is strengthened by an underlying fillet 58 (see FIGS. 10 and 11).

Figure 8:
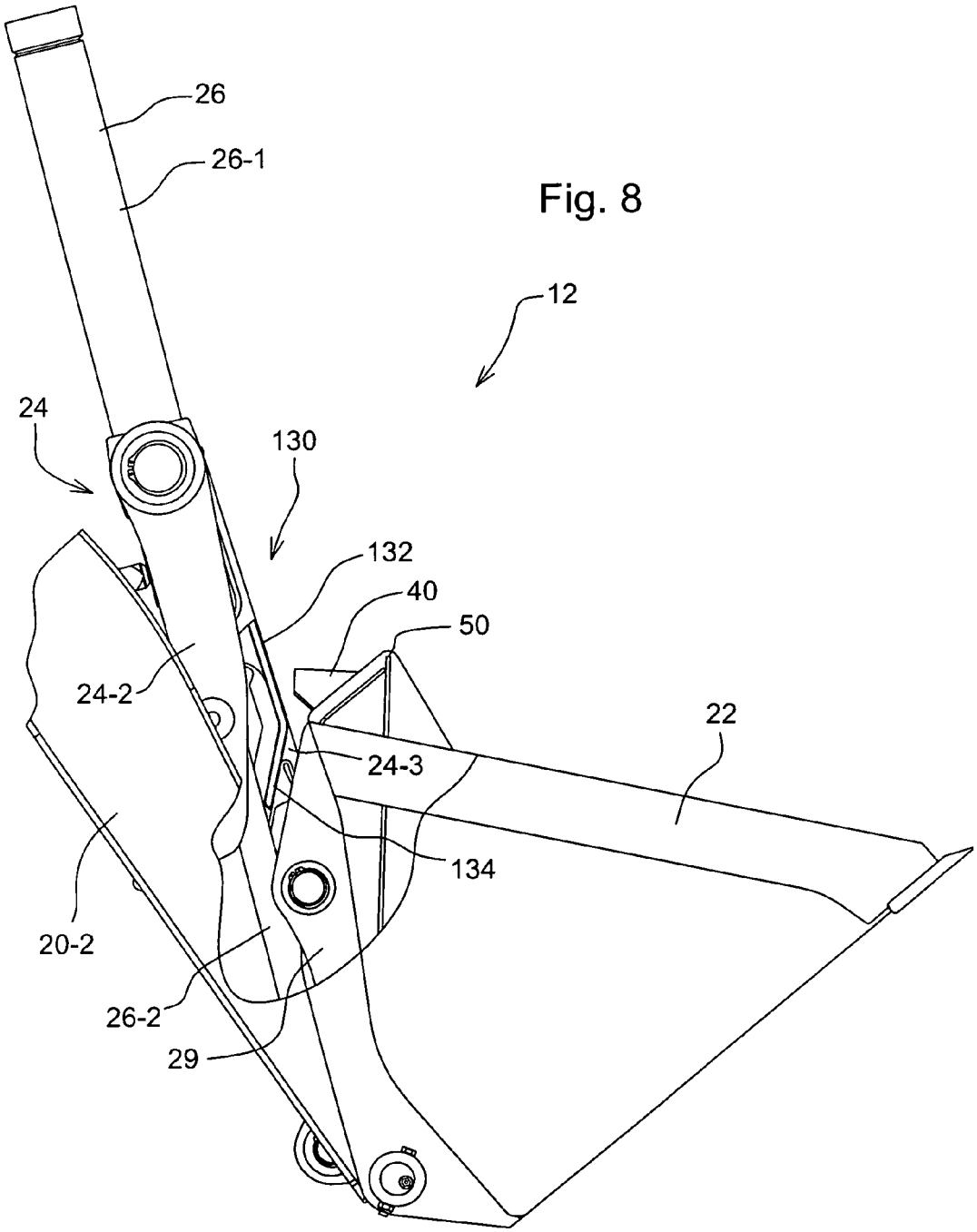
FIG. 8 is a fragmentary side elevation view of the loader showing the second debris guard and the bucket in its full roll-back or dump position.
Figures 9, 10, 11, 12, 13, 14:
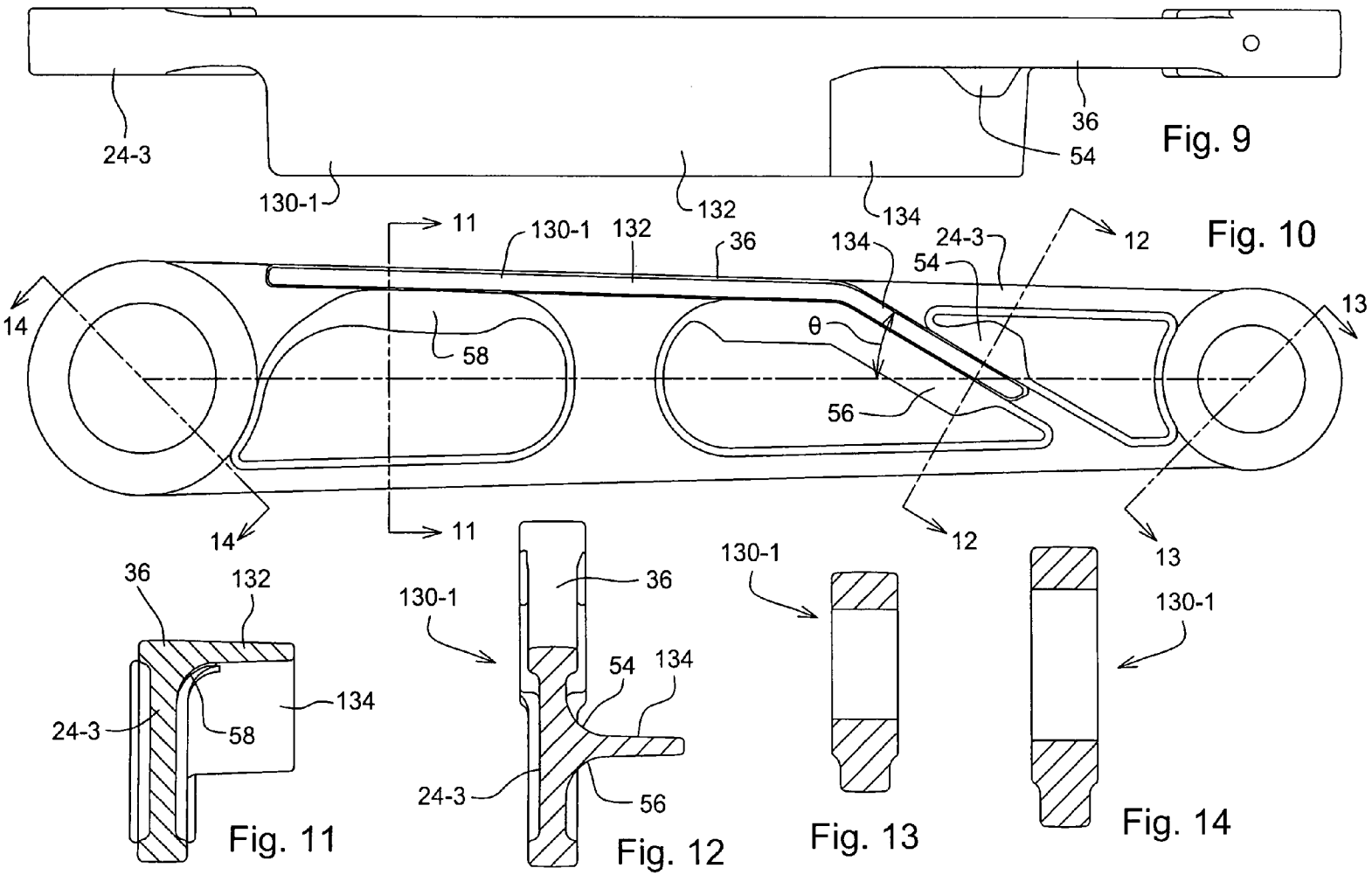
FIG. 9 is a top view showing a first monolithic structure in the form of, for example, a casting including a link of the bucket linkage and a first half or component of the second debris guard integral with the link.
FIG. 10 is a side elevation view of the first monolithic structure.
FIG. 11 is a sectional view taken along lines 11-11 of FIG. 10.
FIG. 12 is a sectional view taken along lines 12-12 of FIG. 10.
FIG. 13 is a sectional view taken along lines 13-13 of FIG. 10 showing a bore at one end of the link.
FIG. 14 is a sectional view taken along lines 14-14 of FIG. 10 showing a bore at the other end of the link.

The second wall 134 extends from and is angled relative to the first wall 132, providing clearance for the bucket 22 upon roll-back of the bucket 22 to its full roll-back position (see FIG. 8). The second wall 134 is strengthened by an overlying fillet 54 and an underlying fillet 56 (see FIGS. 10 and 12). The second wall 134 matches an angle of a portion of the bucket 22, in particular, the pivot plates 28, when the bucket 22 assumes its full roll-back position. As such, the second wall 134 is angled relative to the top and bottom edges 36, 38 of the respective link 24-3, 24-4. Stated otherwise, the second wall 134 is angled relative to a central longitudinal axis 44 of the respective link 24-3, 24-4 at an angle θ of, for example, 30 degrees.

Further, the angle of the second wall 134 "softens" the pinch region between the debris guard 130 and the bucket 22 so as to reduce loading therebetween. The angle would allow smaller pieces of material between the pivot plates 29 onto the rod 26-2 in the pinch region between the rod 26-2 and the bucket 22, but such material should not be large enough to damage the rod 26-2 upon roll-back of the bucket 22.

In a third embodiment of the debris guard (not shown), the debris guard may be pivotally attached to the first and second pins 25 extending laterally outwardly away from the cylinder 26 and to the pin 28, rather than directly to the links 24-3, 24-4. In such a case, the debris guard would obstruct much of the space between the links 24-3, 24-4 so as to block passage of larger material between the links 24-3, 24-4 onto the rod 26-2 in the pinch region between the bucket 22 and the rod 26-2.

The debris guard and its various embodiments may be installed during assembly of the vehicle 10 as original equipment, or may be retrofitted onto the vehicle 10. The debris guard 30 is particularly useful for retrofitting, while the debris guard 130 may be used primarily as original equipment.

The debris guard and its various embodiments are described as being particularly useful with the 410J. It is understood that the debris guard and its various embodiments may be used with other makes and models of backhoe loaders.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A loader for a work vehicle, comprising:

a lift arm, a bucket pivotally attached to the lift arm, a bucket linkage pivotally attached to the lift arm, the bucket linkage comprising a first link and a second link, the first and second links pivotally attached to the bucket, and a hydraulic bucket cylinder pivotally attached to the first and second links and the bucket and operable to pivot the bucket relative to the lift arm via a pin disposed on the bucket, wherein the bucket linkage comprises a debris guard extending along and between the first and second links and over a portion of the bucket cylinder extending between the bucket linkage and the bucket, substantially obstructing a space defined between the first and second links and between the bucket cylinder and the bucket.

2. The loader of claim 1, wherein the debris guard is integral with the first link and the second link.

3. The loader of claim 2, wherein the debris guard comprises a first component integral with the first link and a second component distinct from the first component and integral with the second link.

4. The loader of claim 3, wherein the first link and the first component are included in a first casting, and the second link and the second component are included in a second casting.

5. The loader of claim 3, wherein the first and second components extend respectively from the first and second links toward one another.

6. The loader of claim 5, wherein the first and second components are spaced apart from one another.

7. The loader of claim 3, wherein each of the first component and the second component comprises an elongated first wall extending along an edge of the respective first or second link and a second wall extending from and angled relative to the first wall, providing clearance for the bucket upon roll-back of the bucket to the bucket's full roll-back position.

8. The loader of claim 1, wherein the debris guard is fastened to the first and second links for removal therefrom.

9. The loader of claim 8, wherein the debris guard is pivotally attached to the bucket.

10. The loader of claim 8, wherein the debris guard comprises a panel, a first hook attaching the panel to the first link, and a second hook attaching the panel to the second link.

11. The loader of claim 10, wherein the panel comprises a first hole through which the first hook extends and a second hole through which the second hook extends.

12. The loader of claim 8, wherein the debris guard comprises a panel hooked onto the first and second links, a tang extending from the panel toward the bucket, and a flange fixed to an underside of the tang, the tang is narrower than the panel, and the flange receives a pin of the bucket linkage interconnecting the first and second links and the bucket.

13. The loader of claim 8, wherein the debris guard comprises a plate on the first and second links.

14. The loader of claim 1, wherein the debris guard is mounted to the first and second links.

15. The loader of claim 1, wherein the debris guard is positioned in fixed relation to the first link and the second link.

16. The loader of claim 1, wherein the loader is configured for attachment to a backhoe loader.

* * * * *